US006237577B1

(12) United States Patent
Takahashi et al.

(10) Patent No.: US 6,237,577 B1
(45) Date of Patent: May 29, 2001

(54) BREATHER STRUCTURE FOR FOUR CYCLE ENGINE

(75) Inventors: Katsunori Takahashi; Tetsuya Nakanishi, both of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/395,369

(22) Filed: Sep. 14, 1999

(30) Foreign Application Priority Data

Sep. 14, 1998 (JP) ..... 10-279428

(51) Int. Cl.[7] ..... F01M 13/00
(52) U.S. Cl. ..... 123/572
(58) Field of Search ..... 123/572, 573, 123/574, 41.86, 179.25

(56) References Cited

U.S. PATENT DOCUMENTS 4,607,604 * 8/1986 Kanoh et al. ..... 123/572
4,848,170 * 7/1989 Inagaki et al. ..... 123/179.25
4,922,881 * 5/1990 Tamba et al. ..... 123/572
5,664,549 * 9/1997 Hutchins ..... 123/572

* cited by examiner

*Primary Examiner*—Marguerite McMahon
(74) *Attorney, Agent, or Firm*—Birch, Stewart, Kolasch & Birch, LLP

(57) ABSTRACT

A partition is provided integrally with a cam holder. An inlet is provided in this partition. This inlet is located sliding on a rotating surface of cams. A rib is formed integrally with the cam holder makes it difficult for oil to scatter from the cams. The wall of the cam holder and the cylinder head cover are sealed and connected by a gasket, and a breather chamber is formed between them. The breather chamber can be easily formed.

10 Claims, 5 Drawing Sheets

BREATHER STRUCTURE FOR FOUR CYCLE ENGINE

BACKGROUND OF THE INVENTION

1. Field of the Invention

The present invention relates to a breather structure for a four cycle engine.

2. Description of the Background Art

As a breather structure for a four cycle engine, a head cover and a breather plate together constitute a breather chamber. A chimney-like projection is provided on the breather plate for preventing oil from flowing into the breather chamber. An alternative breather structure utilizes a plate with a hole formed therein which do not require a chimney-like projection.

The oil scattered by a cam is likely to fall in the breather chamber. Therefore, the breather chamber has a complicated structure in order to ensure its effective performance. Also, although the provision of a chimney-like projection on the plate is effective in preventing oil invasion, it results in a complicated plate and an increased cost.

SUMMARY OF THE INVENTION

In order to solve the above problem, a partition is formed which is integrated with a cam holder for separating the cam holder into upper and lower spaces. The upper space of the cam holder and the partition are used as a breather chamber. Accordingly, a separate breather plate does not need to be provided. This allows easy formation of a breather chamber having a simple structure.

The breather chamber inlet and a separated oil returning hole are formed on the partition. These openings can be formed when the cam holder is formed. The breather chamber inlet and the separated oil returning opening are formed between intake and exhaust cam shafts, and freedom for positioning the openings is increased. The intake/exhaust cam holder is integrally formed with the partition, and they can be formed easily. However, these elements may be formed separately.

A pair of partitions may by formed above and below the cam holder, such that a breather chamber can be formed into two-story structure. A plate is provided for further separating the breather chamber, and oil separation ability can be improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
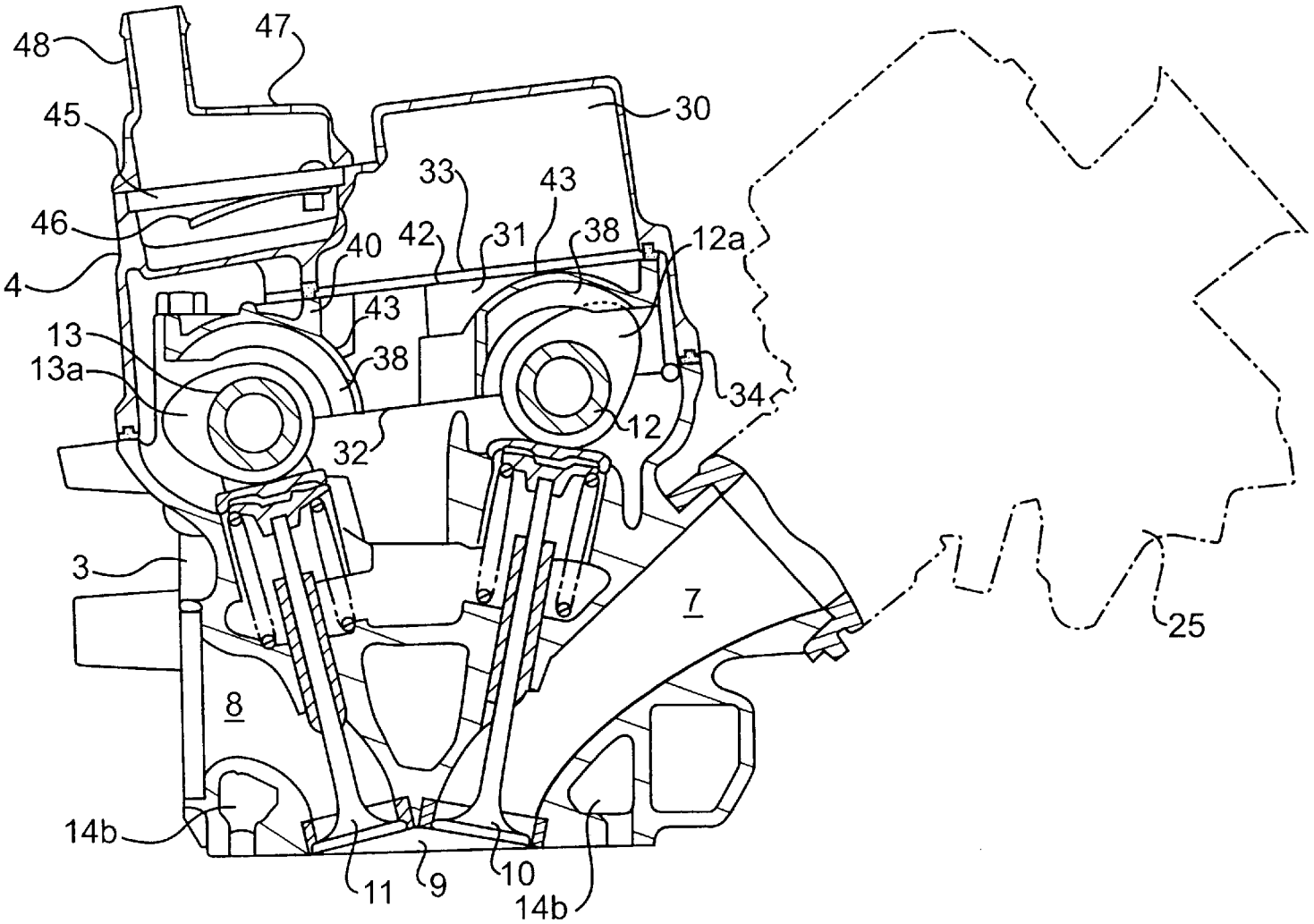
FIG. 1 is an enlarged cross-sectional view showing main parts of an engine.
Figure 2:
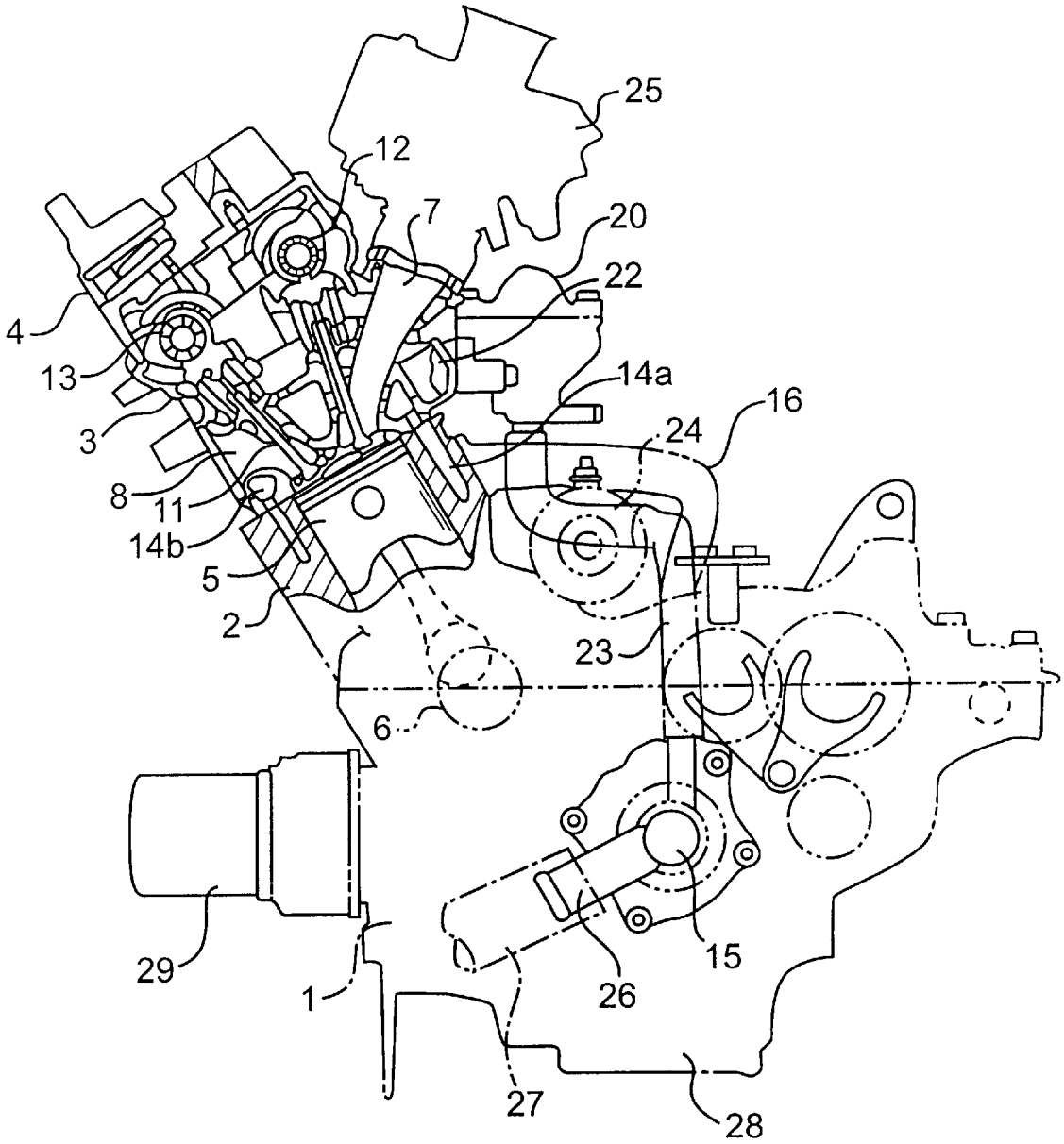
FIG. 2 is a side view showing the entire engine with a partial cut-away.

A first preferred embodiment of the present invention applied to a motorcycle engine will be described with reference to FIGS. 1 to 4. A four cycle water cooled engine of the dual overhead camshaft type (DOHC) has a crankcase 1, a cylinder 2, a cylinder head 3, and a cylinder head cover 4, which is a part of the cylinder head 3.

A piston 5, slidably accommodated in the cylinder 2, is communicated with a crankshaft 6 (the center thereof is shown) in the crankcase 1, and forms an ignition chamber 9 between itself and the cylinder 2 and the cylinder head 3.

An intake port 7 and an exhaust port 8, communicating with the ignition chamber 9, are provided in the cylinder head 3. The intake port 7 and exhaust port 8 are opened and closed by an intake valve 10 and an exhaust valve 11, respectively. The intake valve 10 and the exhaust valve 11 are driven by the cams on camshafts 12, 13, which rotate in synchronism with the crankshaft 6.

Reference numerals 14*a*, 14*b* in the drawing indicate water jackets, 15 indicates a water pump, 16 indicates a water hose, 20 indicates a thermostat case, 22 indicates a cooling water outlet, 23 indicates a bypass hose, 24 indicates a starter motor, 25 indicates a carburetor, 26 indicates an intake pipe for receiving cooling water from a radiator via a water hose, 27, 28 indicates a oil pan, and 29 indicates an oil filter.

A breather chamber 30 is provided in the upper part of the cylinder head cover 4, between the cylinder head cover 4 and the cam holder 31. An inlet 32 of the breather chamber 30 is formed as an opening of the cam holder 31 and also serves as an opening for oil to return to the cylinder head 3. The space between the cylinder head cover 4 and the cam holder 31 is sealed by a cam holder gasket 33, which is formed integrally with an external head cover gasket 34, which is interposed between the cylinder head 3 and the cylinder head cover 4.

Figure 3:
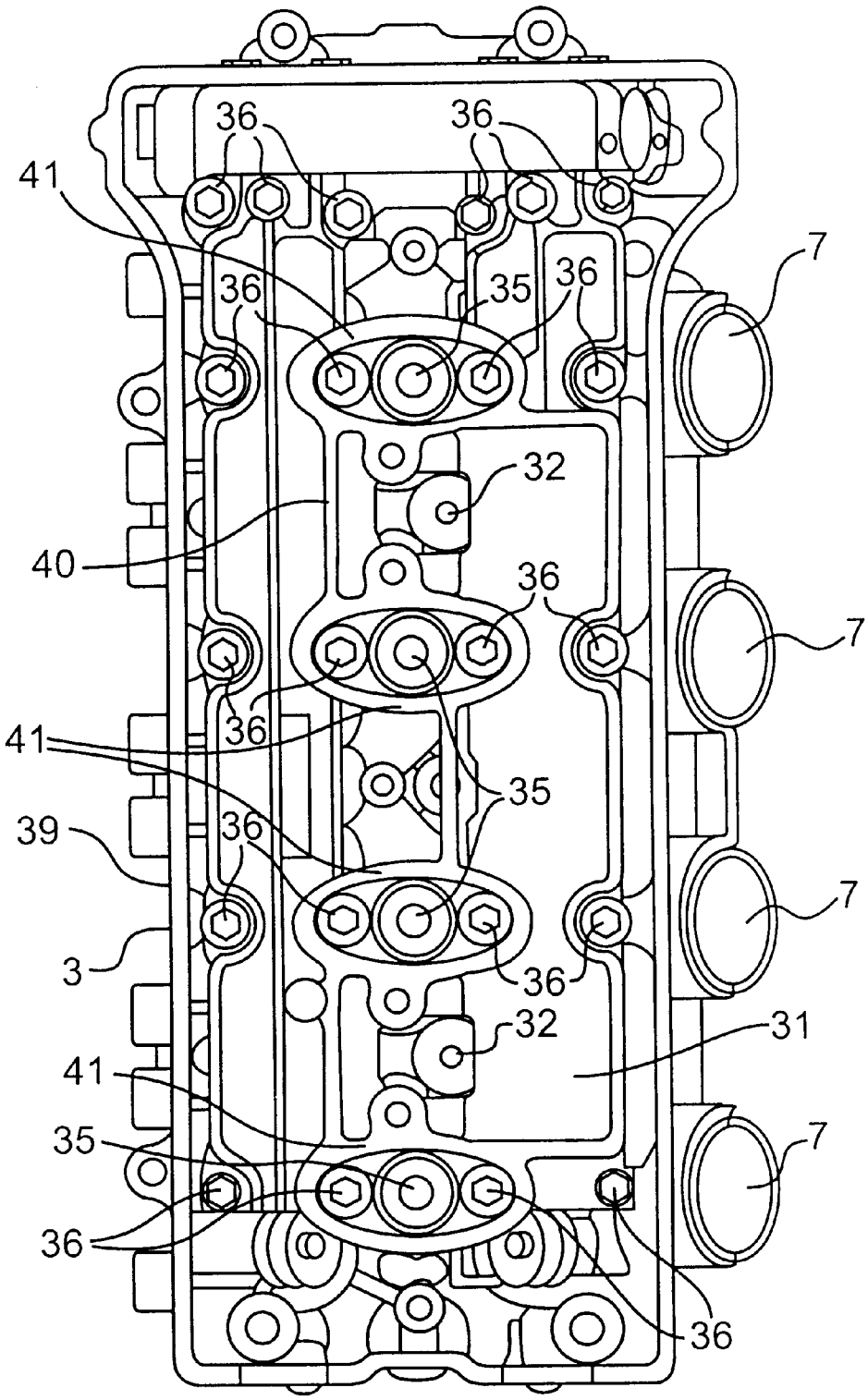
FIG. 3 is a plan view showing a cam holder.
Figure 4:
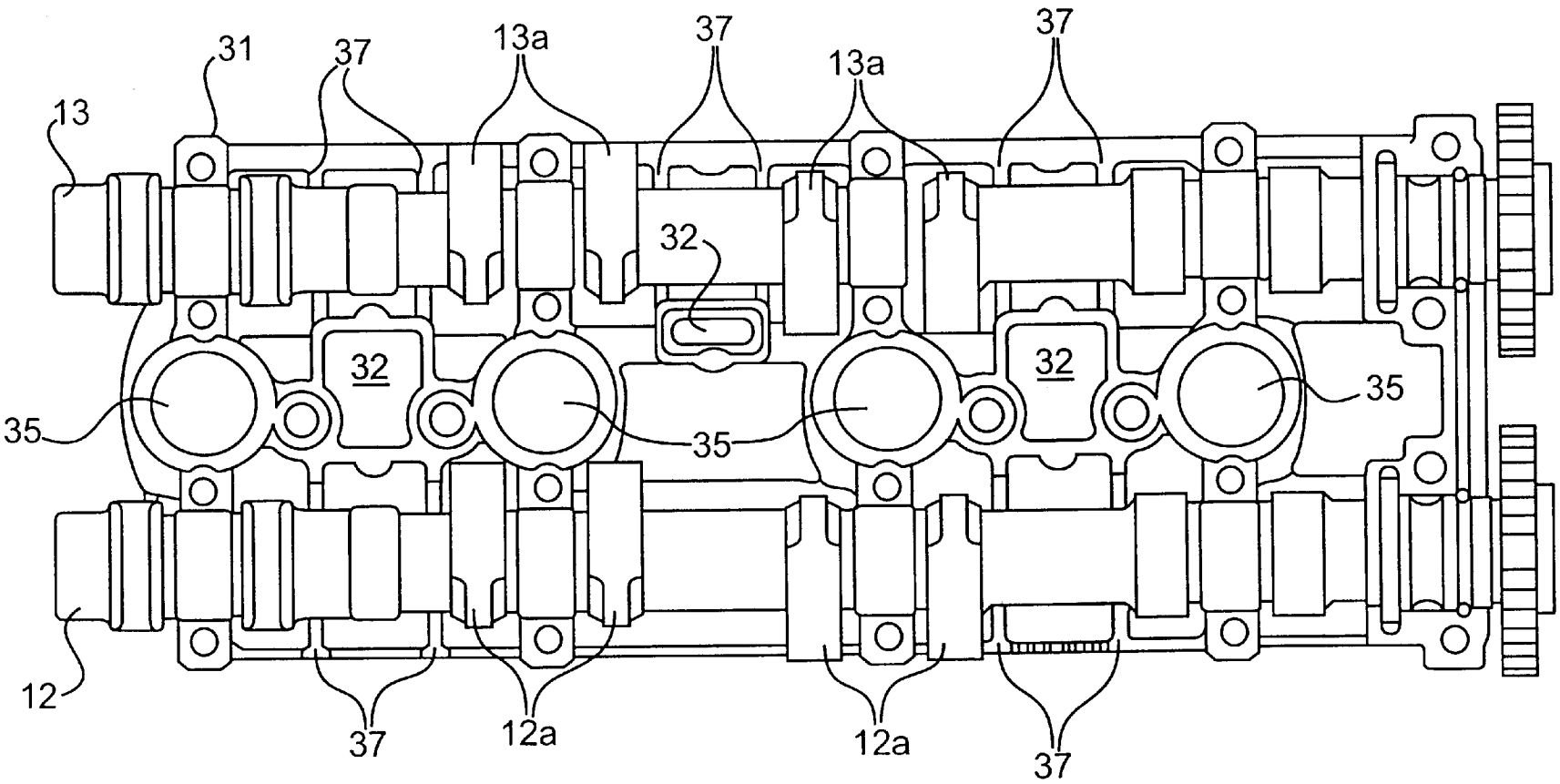
FIG. 4 is a view showing a base side of the cam holder and a cam shaft.

As shown in FIGS. 3 and 4, the inlet 32 is formed in the intermediate part between adjacent plug holes 35 in the longitudinal direction of the vehicle. The inlet 32 is located in the lowest position, serving as a path through which oil scattered towards the cam holder 31 returns to the cylinder head 3. The inlet 32 is positioned in the intermediate part between tightening bolts 36 of the cam holder 31, away from the rotation surface of the cams 12*a*, 13*a* on the respective cam shafts (see FIG. 4). Also, a rib 37 is integrally formed with the cam holder 31 between the rotation surfaces of the cams 12*a*, 13*a*, and the inlet 32, projecting downward to the cylinder head 3 side. With this arrangement, oil scattered by the cams 12*a*, 13*a*, will be extremely unlikely to enter into the inlet 32.

The upper surface of the cam holder 31, where the inlet 32 is formed, is surrounded by an annularly connecting rib 40. The rib 40 communicates with a rib 41, which surrounds each plug hole 35. The height of the upper end surface of these ribs are the same (FIG. 3), constituting a seal surface using the head cover gasket 34.

On the external side of the seal surface, the upper end surface 39 of the wall which surrounds the cylinder head 3 constitutes a seal surface due to the head cover gasket 34 which intervenes between the cylinder head 3 and the cylinder head cover 4. According to the present invention, the gasket 33 and the head cover gasket 34 are formed integrally with each other, and connected to each other like a bridge at an appropriate point (not shown). However, the cam holder gasket 33 may be formed separately from the head cover gasket 34.

A portion of the cam holder 31 constitutes a partition 42 which segregates the inside of the cylinder head cover 4 into a cam chamber and an upper space. A space between the breather chamber 30 and the partition 42 is sealed by the cam holder gasket 33. The partition 42 includes an arc-shaped cover 43, which curvingly covers the upper part of the cams 12*a*, 13*a*. The spaces between the cams 12*a* and 13*a* constitute valley-like low parts, some of them having an inlet 32 formed thereon.

A reed valve 46 is provided in the reed valve chamber 45, and is covered by a cover 47 different from the cylinder head cover 4. The cover 47 has a joint pipe 48 formed integrally therewith, from which refined air is taken in as secondary air to be supplied to the exhaust port 8 as a result of the effect of exhaust pulsation of the exhaust port 8.

Next, the operation of the preferred embodiment will be described. The partition 42 is integrally formed with the cam holder 31 in order to separate the cam holder 31 into upper and lower parts. Since the upper space 42 of the cam holder 31 and the partition 42 is used as a breather chamber 30, there is no need to provide a separate breather plate. Also, since a separated oil return opening is formed on the partition 42, which also serves as a breather chamber inlet 32, the opening can be formed at the same time as the cam holder is formed.

Further, since a breather chamber inlet 32 and the separated oil return opening are formed between the intake and exhaust cam shafts 12, 13, freedom with which to determine a position for the openings is increased. Moreover, since the cam holder 31 and the partition 42 are integrally formed, they can be formed easily.

Figure 5:
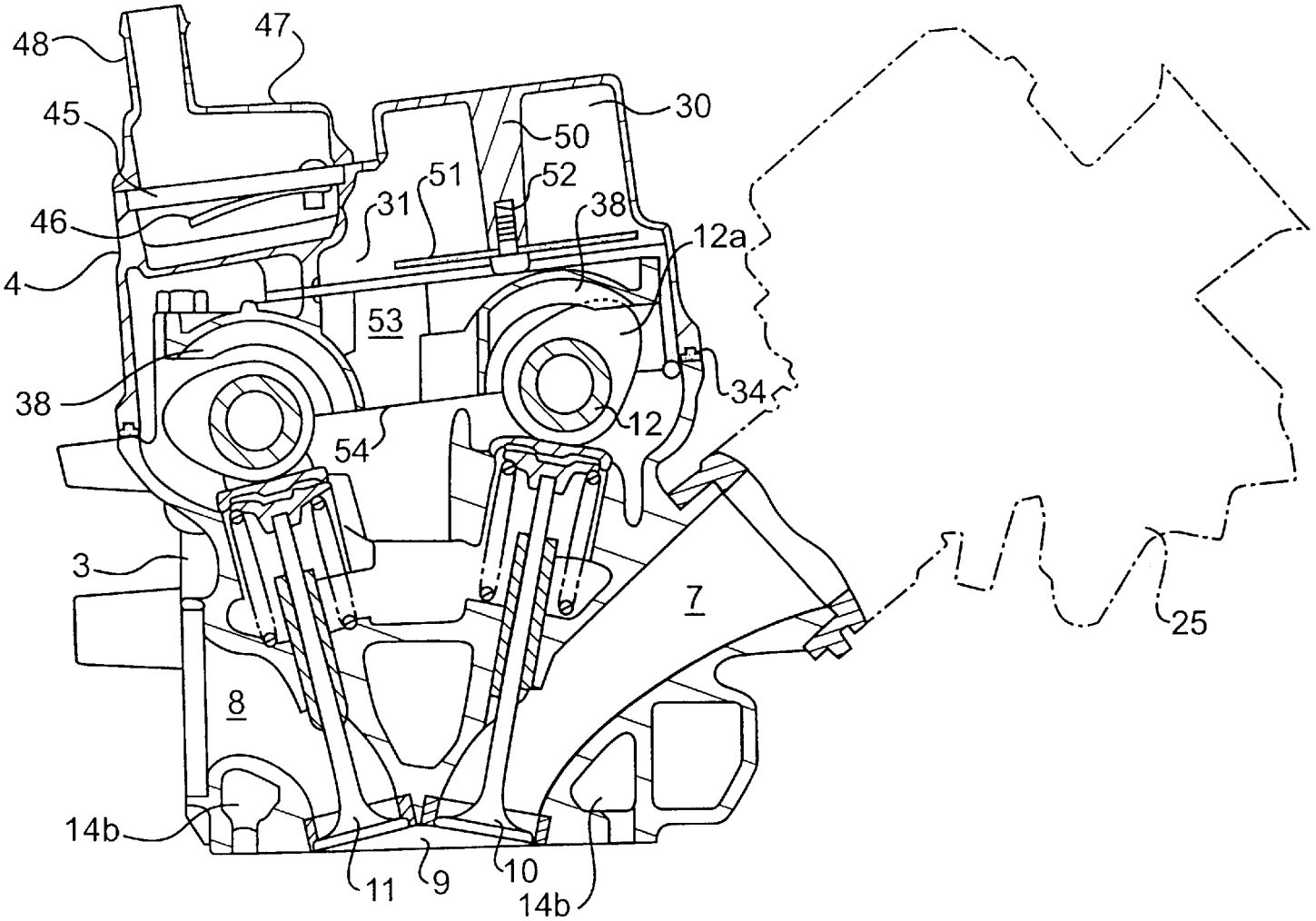
FIG. 5 is a cross-sectional view showing a second preferred embodiment corresponding to FIG. 1.

FIG. 5 is a diagram showing a second preferred embodiment, corresponding to FIG. 1. In this example, a breather plate 51 is attached via a bolt 52 to a boss 50, which is formed integrally with the cylinder head cover 4, protruding downwardly from the upper part of the cylinder head cover 4, whereby the cylinder head cover 4 and the breather plate 51 constitute a breather chamber 30.

A cam holder 31 has the same structure as that of the previous preferred embodiment. A sub-breather chamber 53 is formed at a position substantially the same as the inlet 32. The sub-breather chamber 53 is surrounded by the rib 38, being formed integrally with the cam holder 31.

The position of the inlet 32 in the previous embodiment constitutes the inlet 54 of the sub breather chamber 53, and the boundary from the upper end of the breather chamber 53 constitutes an inlet 32 of the breather chamber 30.

In addition, when a pair of partitions 42, 51 are formed in the upper and lower parts of the cam holder 31, the breather chambers 30, 53 can be formed into a two-story structure. Further, since a partition 51 is provided for separating the breather chambers 30 and 53, oil separating ability can be improved.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A breather structure for a four cycle engine comprising:

a cam holder for supporting an intake camshaft and an exhaust camshaft; and a partition integrally formed with said cam holder for separating the cam holder into upper and lower spaces, said upper space of the cam holder and the partition forming a breather chamber, wherein a breather chamber inlet and a separated oil returning opening are formed in said partition, and wherein said breather chamber inlet and said separated oil returning opening are formed between the intake and exhaust camshafts.

2. The breather structure for a four cycle engine according to claim 1, wherein a pair of partitions are formed in the upper-lower direction of the cam holder.

3. The breather structure for a four cycle engine according to claim 1, wherein a plate is provided for further separating the breather chamber.

4. A breather structure for a four cycle engine comprising:

a cam holder for supporting an intake camshaft and an exhaust camshaft;

a partition located within said cam holder for separating the cam holder into upper and lower spaces, said upper space of the cam holder and the partition forming a breather chamber; and a valve mechanism in communication with said breather chamber for allowing venting of said breather chamber through said valve mechanism, wherein said cam holder includes at least one breather chamber inlet formed therein between the intake camshaft and the exhaust camshaft.

5. The breather structure for a four cycle engine according to claim 4, wherein said partition is integrally formed with said cam holder as a one-piece unitary member.

6. The breather structure for a four cycle engine according to claim 4, wherein said partition includes an oil return hole formed therein.

7. The breather structure for a four cycle engine according to claim 4, wherein said valve mechanism includes a reed valve which allows flow therepast in one direction, and prevents flow therepast in an opposite direction.

8. The breather structure for a four cycle engine according to claim 7 further comprising a second partition located within said cam holder for separating the breather chamber into a main breather chamber and a sub-breather chamber.

9. The breather structure for a four cycle engine according to claim 8, wherein said partition includes an oil return hole formed therein.

10. The breather structure for a four cycle engine according to claim 4, further comprising a second partition located within said cam holder for separating the breather chamber into a main breather chamber and a sub-breather chamber.

* * * * *